US006764021B1

(12) United States Patent
Birt et al.

(10) Patent No.: US 6,764,021 B1
(45) Date of Patent: Jul. 20, 2004

(54) CONCRETE RAILROAD GRADE CROSSING PANELS

(75) Inventors: Randall G. Birt, Omaha, NE (US); Thomas L. Egan, Omaha, NE (US)

(73) Assignee: American Concrete Products Co., Omaha, NE (US)

( * ) Notice: Subject to any disclaimer, the term of this patent is extended or adjusted under 35 U.S.C. 154(b) by 22 days.

(21) Appl. No.: 10/147,234

(22) Filed: May 15, 2002

Related U.S. Application Data

(63) Continuation-in-part of application No. 10/103,308, filed on Mar. 20, 2002.

(51) Int. Cl.[7] ..... E01B 21/00
(52) U.S. Cl. ..... 238/2; 238/8
(58) Field of Search ..... 238/2, 5, 6, 7, 238/8, 9; 404/17, 32, 33

(56) References Cited

U.S. PATENT DOCUMENTS

| | | | | |
|---|---|---|---|---|
| 1,694,557 A | | 12/1928 | Oettinger | |
| 2,789,771 A | | 4/1957 | Bishop | |
| 2,950,057 A | | 8/1960 | Speer | |
| 3,056,555 A | | 10/1962 | Eisses | |
| 3,066,869 A | | 12/1962 | Bishop | |
| 3,469,783 A | | 9/1969 | Uralli et al. | |
| 3,825,184 A | | 7/1974 | Hartl | |
| 3,863,840 A | | 2/1975 | Szarka et al. | |
| 3,892,356 A | | 7/1975 | Harmon | |
| 3,955,761 A | | 5/1976 | Szarka et al. | |
| 4,093,120 A | | 6/1978 | Canfield | |
| 4,147,304 A | | 4/1979 | Blyton | |
| 4,236,670 A | | 12/1980 | Limmergard et al. | |
| 4,253,605 A | | 3/1981 | Sims | |
| 4,267,969 A | | 5/1981 | Hales et al. | |
| 4,365,743 A | | 12/1982 | Trickel et al. | |
| 4,368,845 A | | 1/1983 | Perry et al. | |
| 4,449,666 A | | 5/1984 | Hales et al. | |
| 4,457,468 A | | 7/1984 | Hales et al. | |
| 4,461,421 A | | 7/1984 | Maass | |
| 4,641,779 A | | 2/1987 | O'Brien et al. | |
| 4,691,863 A | | 9/1987 | Smith | |
| 4,793,545 A | | 12/1988 | Raymond | |
| D301,435 S | * | 6/1989 | Martin | D12/49 |
| 4,860,952 A | | 8/1989 | Schmidt | |
| 4,899,932 A | | 2/1990 | Beachy et al. | |
| 4,899,933 A | | 2/1990 | Martin | |
| 4,911,360 A | | 3/1990 | Spurr | |
| 5,096,117 A | | 3/1992 | Owen | |
| 5,181,657 A | | 1/1993 | Davis | |
| 5,464,152 A | | 11/1995 | Wabnitz | |
| 5,535,947 A | | 7/1996 | Hogue et al. | |
| 5,535,948 A | | 7/1996 | Williams | |
| 5,538,182 A | | 7/1996 | Davis et al. | |
| 5,609,294 A | | 3/1997 | Lucas, Jr. | |
| 5,626,289 A | | 5/1997 | Demers, Jr. et al. | |
| 5,655,711 A | | 8/1997 | Hull et al. | |
| 5,740,961 A | | 4/1998 | Bruning | |
| 5,813,602 A | * | 9/1998 | Holland | 238/8 |
| 5,850,970 A | | 12/1998 | Hull et al. | |
| 5,899,379 A | | 5/1999 | Bruyn et al. | |
| 6,068,195 A | * | 5/2000 | Gaudet | 238/8 |
| 6,079,630 A | | 6/2000 | Schroeder | |
| 6,129,288 A | * | 10/2000 | Petersen et al. | 238/8 |
| 6,431,462 B1 | * | 8/2002 | Apostolou et al. | 238/8 |
| 6,439,470 B1 | * | 8/2002 | Hull | 238/8 |

* cited by examiner

*Primary Examiner*—Frantz F. Jules
(74) *Attorney, Agent, or Firm*—Thomte, Mazour & Niebergall; Dennis L. Thomte

(57) ABSTRACT

A concrete railroad grade crossing comprised of a precast concrete gauge panel extending between the rails and precast concrete approach panels which extend between each rail and the roadway. Elastomeric gauge seals are provided on the opposite sides of the gauge panels for sealing the space between the sides of the gauge panels and the rails. Elastomeric approach seals are provided on the inner ends of the approach panels for engagement with the outer sides of the rails. The inner ends of the seals have lobes formed therein which are embedded in the respective panels.

23 Claims, 5 Drawing Sheets

CONCRETE RAILROAD GRADE CROSSING PANELS

CROSS-REFERENCE TO RELATED APPLICATION

This is a continuation-in-part application of Petitioners' earlier application Ser. No. 10/103,308 filed Mar. 20, 2002, entitled "CONCRETE RAILROAD GRADE CROSSING PANELS".

BACKGROUND OF THE INVENTION

1. Field of the Invention

This invention relates to an improved concrete railroad grade crossing and more particularly to an improved railroad grade crossing comprising concrete gauge panels which extend between the rails and further comprising concrete approach or field panels which extend between each rail and the roadway. Even more particularly, the invention relates to improved elastomeric gauge seals which are partially embedded in the sides of the gauge panels and relates to improved elastomeric approach or field seals which are partially embedded in the inner ends of the approach or field panels.

2. Description of the Prior Art

Frequently, a railroad track crosses a roadway which necessitates that the space between the rails be filled with a material which brings that space up to grade. It is also necessary to bring the approaches on either side of the rails up to grade. In the past, precast concrete panels, or gauge panels, have been positioned between the rails and precast concrete panels, or approach panels, have been positioned on the approach sides of the track. The prior art railroad grade crossings have also used elastomeric seals on the sides of the concrete gauge panels to fill the space between the gauge panels and the rails to prevent foreign materials from entering and filling the space between the gauge panels and the rail. The prior art railroad grade crossings have also used elastomeric seals on the inner ends of the concrete approach panels to prevent foreign materials from entering and filling the space between the approach panel and the associated rail. In some cases, the upper inner ends of the approach panels and the upper outer ends of the gauge panels were chamfered or beveled to prevent portions of the concrete approach panels and gauge panels from chipping off and filling the spaces between the panels and the rails. In other cases, angle irons have been used as edge protectors to prevent the chipping problem.

In later years, the gauge seals and approach seals have been partially embedded in the concrete panels to aid in attaching the seals to the panels. However, even where the seals are partially embedded in the prior art concrete panels, it is believed that the prior art devices experience some attachment problems of the seals. Applicants' co-pending application is believed to solve at least some of the attachment problems. The instant invention is believed to represent a further advance in the art.

SUMMARY OF THE INVENTION

A railroad grade crossing for extending a roadway across a pair of parallel spaced-apart rails is disclosed. The railroad grade crossing includes one or more concrete gauge panels which extend substantially between the rails. Each of the gauge panels has a top surface which is substantially coplanar with the roadway with the bottom surface of the gauge panel being supported upon the ties. Each of the gauge panels has an elastomeric gauge seal on each side thereof which are positioned adjacent the rails. The upper ends of the gauge seals are positioned downwardly from the top surface of the gauge panel with the upper ends of the gauge seals having arcuate recessed portions formed therein adjacent the outer ends thereof. The lower inner ends of the gauge seals are at least partially embedded in the outer ends of the gauge panels. Concrete approach panels or field panels are positioned between each rail and the roadway associated therewith. Each of the concrete approach panels has a top surface which is substantially coplanar with the roadway and a bottom surface which is supported upon the ties. The approach panels have elastomeric approach seals at their inner ends thereof with the upper ends of the approach seals being positioned downwardly from the top surface of the approach panels. The lower inner ends of the approach seals are at least partially embedded in the inner ends of the approach panels. Elongated, metal angle members (edge protectors) are cast in the upper outer edges of the gauge panels and the upper inner edges of the approach panels. Two embodiments of the gauge panel seals and two embodiments of the approach panel seals are disclosed.

It is therefore a principal object of the invention to provide an improved concrete railroad grade crossing.

A further object of the invention is to provide an improved concrete railroad grade crossing comprising concrete gauge panels and concrete approach panels wherein elastomeric seals are partially embedded in the panels and extend therefrom so as to be positioned adjacent the rails.

Still another object of the invention is to provide an improved concrete railroad grade crossing including elastomeric gauge seals and approach seals which have voids formed therein so as to reduce the amount of elastomeric material required to construct the same.

Still another object of the invention is to provide an improved concrete railroad grade crossing including concrete gauge and approach panels which have elastomeric seals partially embedded therein.

Still another object of the invention is to provide an improved method of attaching elastomeric gauge and approach seals to gauge panels and approach panels, respectively.

Still another object of the invention is to provide an improved railroad crossing which has greater durability than the railroad grade crossings of the prior art.

These and other objects will be apparent to those skilled in the art.

DESCRIPTION OF THE PREFERRED EMBODIMENT

Figure 1:
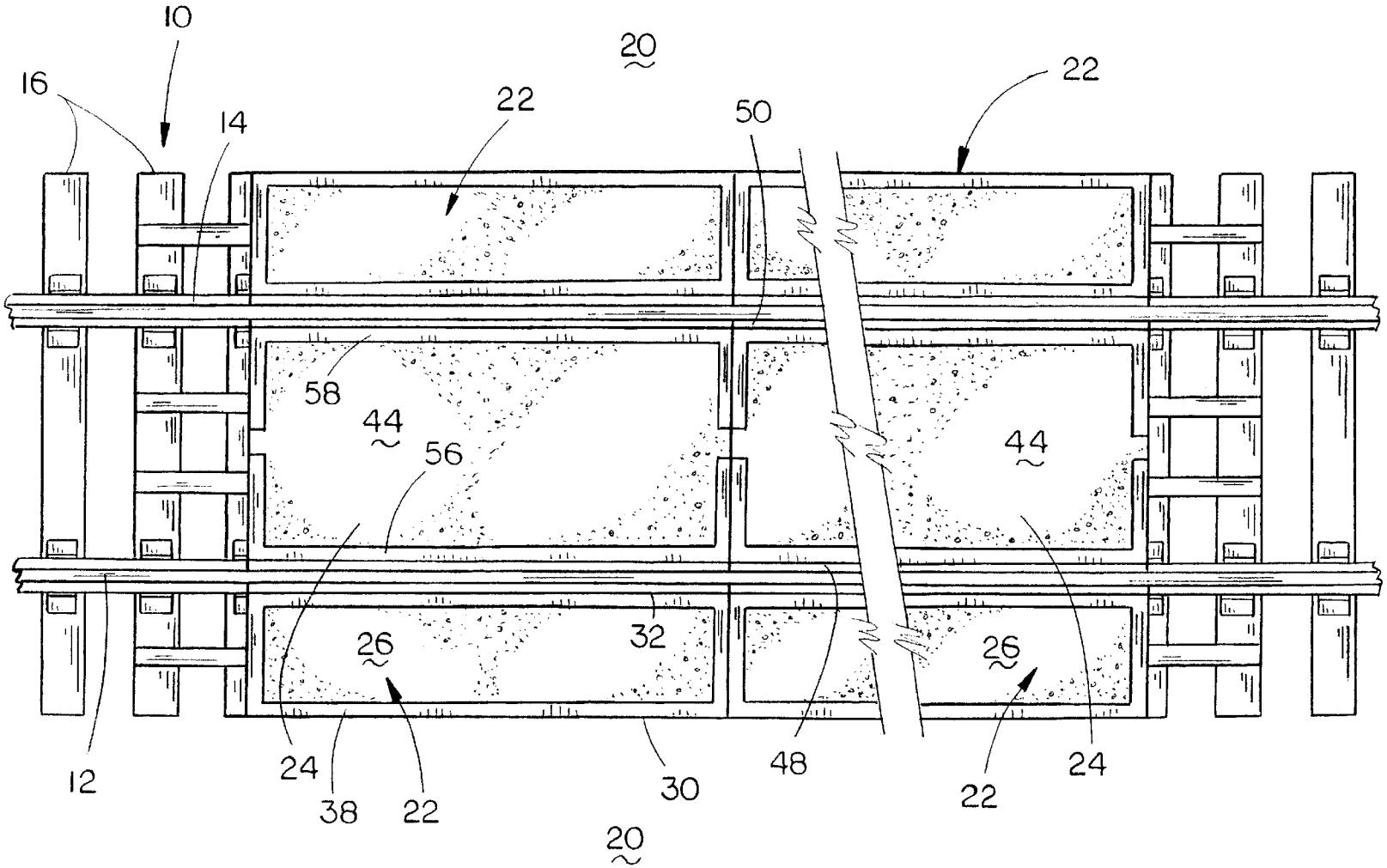
FIG. 1 is a partial top plan view of the concrete railroad grade crossing of this invention.

In the drawings, the numeral 10 refers to a railroad track including rails 12 and 14 which are supported upon a plurality of spaced-apart ties 16 by means of tie plates 18 which are secured to the ties 16 in conventional fashion such as by spikes, clips or bolts. In many cases, the railroad track 10 must cross a roadway which is generally referred to by the reference numeral 20.

Normally, a plurality of precast concrete approach panels 22 will be positioned between the roadway 20 and the rails 12 and 14 with the approach panels 22 being supported upon the outer ends of the ties 16. Normally, the approach panels 22 will be positioned between the roadway 20 and one of the rails in an end-to-end fashion, the number of which will depend upon the width of the roadway and the length of the approach panels. The numeral 24 refers to precast concrete gauge panels which are positioned between the rails 12 and 14 and which are supported upon the ties 16. The gauge panels 24 are supported upon the ties 16 in an end-to-end fashion, the number of which will depend upon the width of the roadway and the length of the gauge panels.

Each of the approach or field panels 22 is comprised of a precast concrete material and includes top surface 26, bottom surface 28, and opposite sides 30 and 32. Approach panel 22 is provided with a recessed portion 34 formed therein at each of the opposite sides thereof to provide a clearance space for the spikes, bolts, clips, etc., which secure the tie plates 18 to the ties 16 and which secure the rail to the tie plate 18 in conventional fashion.

An elongated, metal angle member 38 (edge protector) is cast in the approach panel 22 at the upper inner side thereof, as illustrated in the drawings, and which is held in place in the concrete by horizontally disposed and horizontally spaced rods or bars 40 secured thereto. The angle member 38 is also held in place by a plurality of vertically disposed and horizontally spaced retainers 41 secured thereto having enlarged head portions 41*a* at their lower ends. As will be explained in more detail hereinafter, an approach seal 42 is secured to the inner end of each of the approach panels 22.

Figure 2:
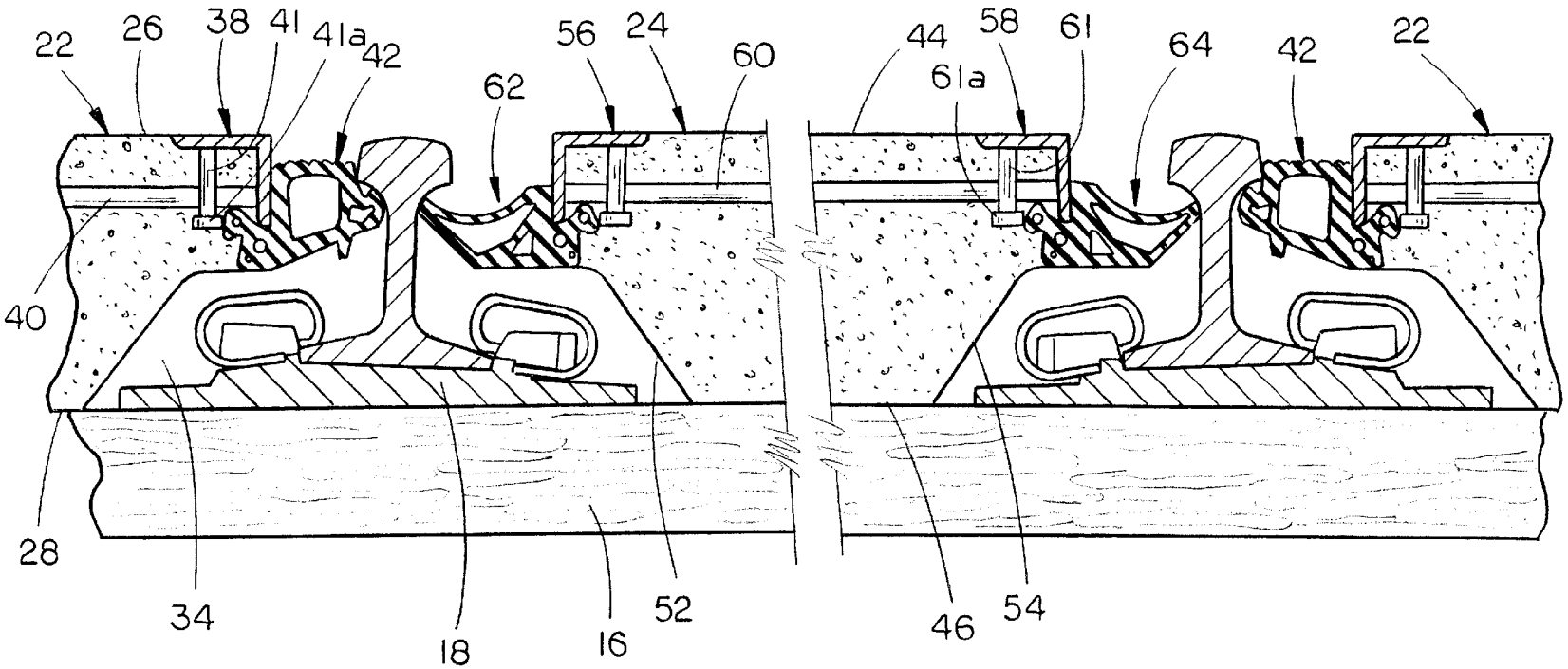
FIG. 2 is a partial vertical sectional view of one of the embodiments of the concrete railroad grade crossing of this invention.

Each of the gauge panels 24 is comprised of a precast concrete material and includes top surface 44, bottom surface 46, and opposite sides 48 and 50. Gauge panel 24 is provided with a recessed portion 52 at side 48 and is provided with a recessed portion 54 at its side 50, as seen in FIG. 2, to provide a clearance space for the spikes, bolts, clips, etc., which secure the tie plates 18 to the ties 16 and which secure the rails to the tie plates 18 in conventional fashion.

Elongated, metal angle members (edge protectors) 56 and 58 are cast in the gauge panel 24 at the upper outer sides thereof, as illustrated in the drawings, and which are held in place by horizontally disposed and horizontally spaced rods or bars 60 secured thereto. The angle members 56 and 58 are also held in place by a plurality of vertically disposed and horizontally spaced retainers 61 secured thereto having enlarged head portions 61*a* at their lower ends. As will be explained in more detail hereinafter, gauge seals 62 and 64 are secured to the outer sides of each of the gauge panels 24. Inasmuch as gauge seals 62 and 64 are identical, only gauge seal 62 will be described in detail.

Figure 3:
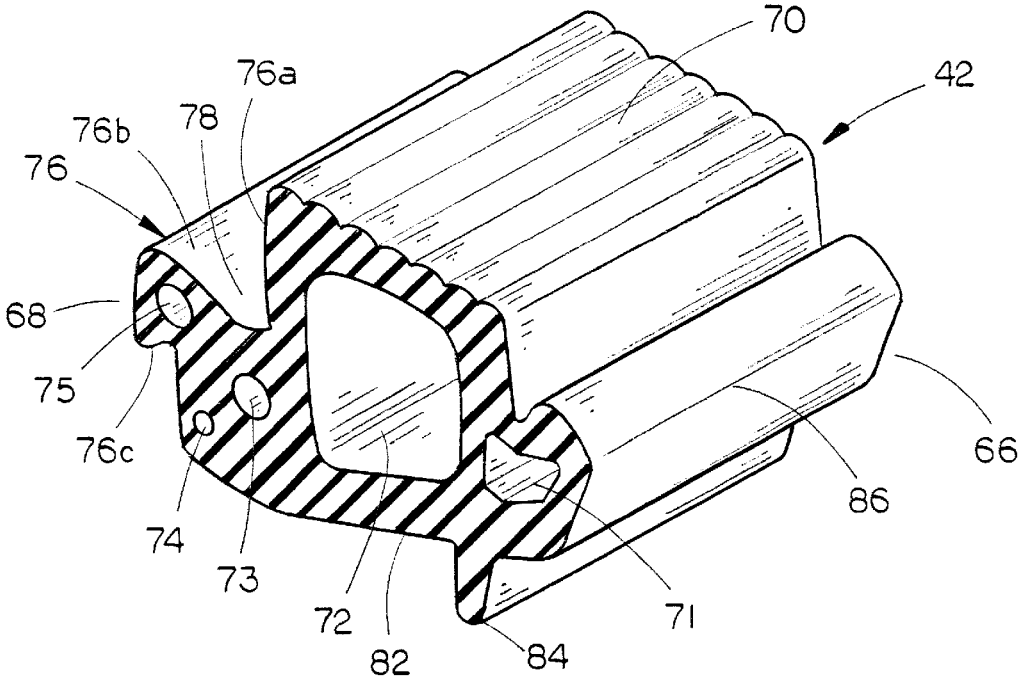
FIG. 3 is a partial perspective view of one of the approach panel seals of the embodiment of FIG. 2.

As seen in FIG. 3, approach seal 42 is comprised of an elastomeric material generally having an outer end 66 and an inner end 68. The upper end 70 of approach seal 42 is ribbed, as illustrated in FIG. 3, with upper end 70 being positioned below the top surface of the panel 22 and below the upper end of the associated rail. Elongated voids 71, 72, 73, 74 and 75 are formed in the approach seal 42 to reduce the amount of material required to fabricate the approach seal. The inner end 66 of approach seal 42 has a lobe or nose 76 extending therefrom which is embedded in the concrete of the panel 22. Lobe 76 defines a recessed area 78 having concrete therein to further aid in securing the approach seal 42 to the panel 22. Recessed area 78 is defined by the vertical face 76*a* of approach seal 42 and the inclined face 76*b*. Lobe 76 also defines a lower surface 76*c* having concrete positioned therebelow to further aid in attaching the approach seal 42 to the panel 22. The concrete which is positioned in the recessed area 78 outwardly of lobe 76 assists in preventing separation of approach seal 42 from panel 22. As seen in FIG. 2, the lower end of angle member 38 is partially received (not embedded) in recessed area 78. As seen in FIG. 3, the lower end of approach seal 42 is tapered upwardly and outwardly at 82 and terminates at a downwardly extending rib 84. The outer end of the approach seal 42 is arcuate in shape, as best seen in FIG. 3, to provide an arcuate surface 86 which is in contact with the arcuate shape of the rail below the head of the associated rail. The engagement of the outer end of the upper end 70 of the approach seal 42 with the side of the head of the rail 12 and the engagement of the arcuate portion 86 with the side of the rail creates a seal to prevent foreign material such as concrete, rocks, etc., from falling down into the space below the approach seal 42.

Figure 4:
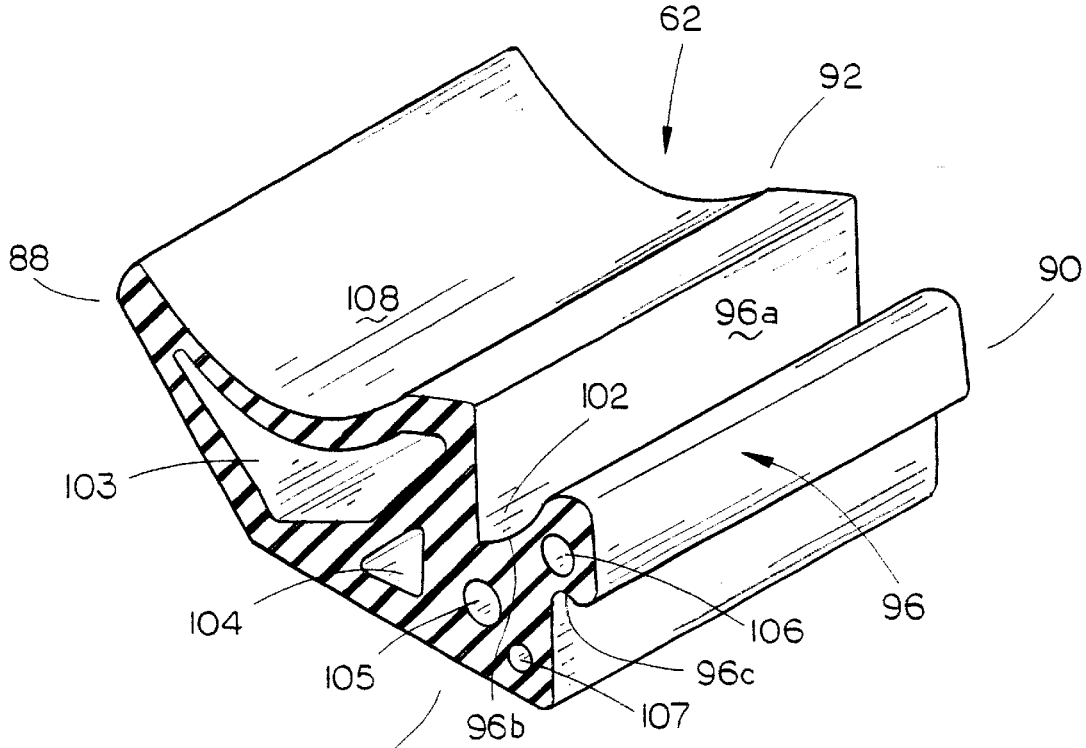
FIG. 4 is a partial perspective view of the gauge panel seal of the embodiment of FIG. 2.

As seen in FIG. 4, each of the gauge seals 62 generally has an outer end 88, inner end 90, upper end 92, and lower end 94. Gauge seal 62 is formed of a suitable elastomeric material and has lobe 96 in its inner end to aid in partially embedding the gauge seal 62 into the concrete of the gauge panel 24. Gauge seal 62 is provided with a recessed area 102 to further aid in securing the gauge seal 62 to the gauge panel 24. Gauge seal 62 is provided with a plurality of elongated voids 103, 104, 105, 106 and 107 formed therein to reduce the amount of material required to fabricate the gauge seal. Recessed area 102 is defined by the vertical face 96*a* of gauge seal 62 and the inclined face 96*b* of lobe 96. Lobe 96 also defines a lower surface 96*c* having concrete positioned therebelow to further aid in attaching the gauge seal 62 to the panel 24. The concrete which is positioned in the recessed area 102 outwardly of lobe 96 assists in preventing separation of gauge seal 62 from panel 24. As seen in FIG. 2, the lower end of angle 56 is partially received (not embedded) in recessed area 102. Void 103 also creates additional flexibility in the outer end of the gauge seal 62 so that it may flex somewhat so as to be in engagement with the arcuate portion of the inner end of the side of the associated rail. Gauge seal 62 is provided with an arcuate recessed portion 108 formed therein for sealing the flange of the railroad wheels moving along the rails.

Figure 5:
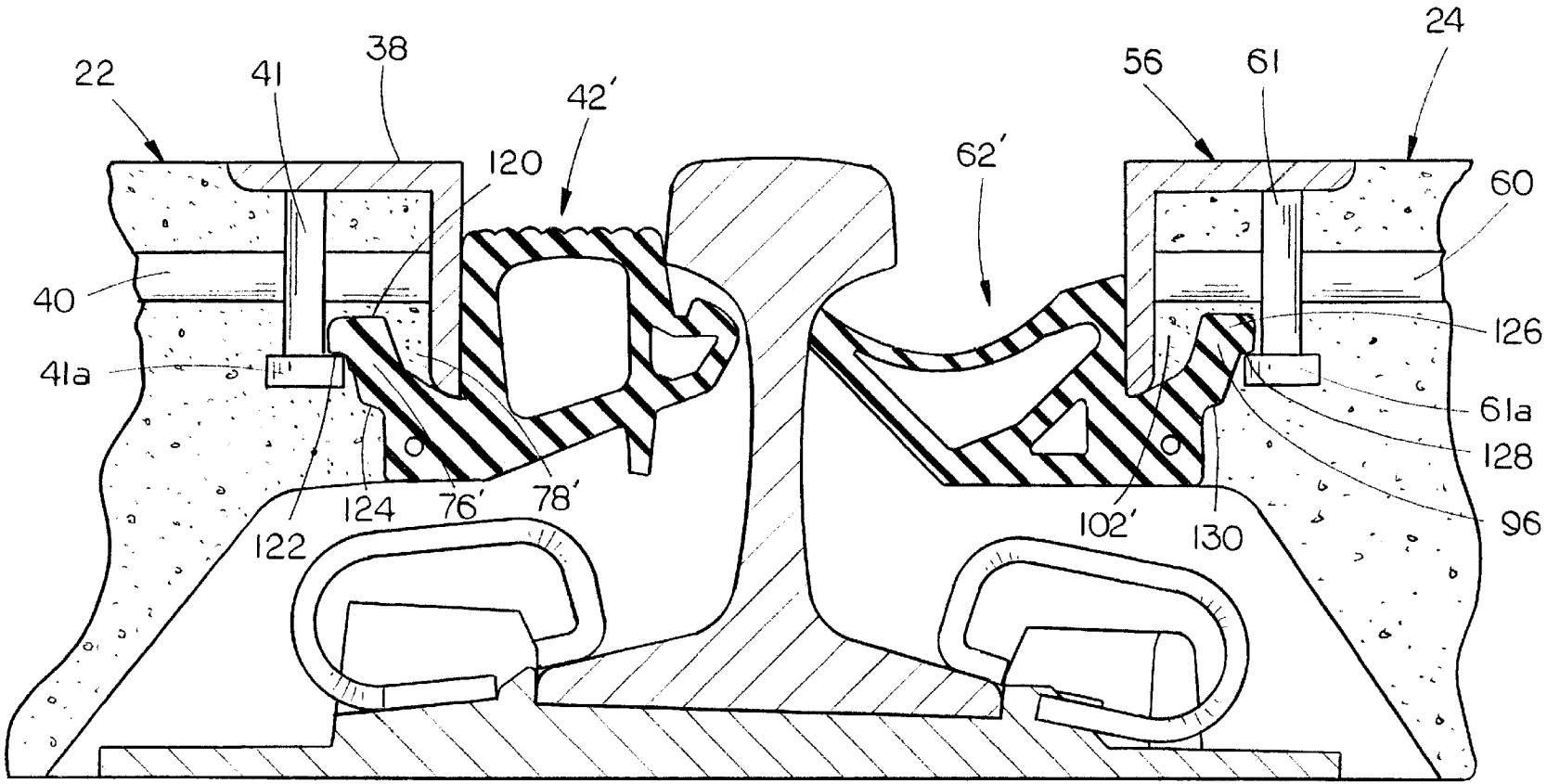
FIG. 5 is a partial vertical sectional view of a second embodiment of the concrete railroad grade crossing of this invention.

FIG. 5 illustrates a second embodiment of the approach and gauge panel seals which are referred to by the reference numerals 42' and 62'. Essentially, the only difference between the approach seals 42 and 42' is that the lobe 76' of approach seal 42' is shaped somewhat differently than lobe 76 of approach seal 42. Lobe 76' has an upper inner head portion 120 having a shoulder 122 at its lower end which is in engagement with the portion 41*a* of the retainers 41 which aids in supporting the approach seal 42' within the approach panel 22. Shoulder 124 is also provided at the inner lower end of lobe 76' to also aid in attaching the approach seal 42' to the panel. Lobe 76' defines a recessed area 78' which is generally similar to recessed area 78 in approach seal 42.

Likewise, the only difference between the gauge seals 62 and 62' is that the lobe 96' of gauge seal 62' is shaped somewhat differently than lobe 96 of gauge seal 62. Lobe 96' has an upper inner head portion 126 having a shoulder 128 at its lower end which is in engagement with the portion 61 a of the retainers 61 which aids in supporting the gauge seal 62' within the gauge panel 24. Shoulder 130 is also provided at the inner lower end of lobe 96' to also aid in attaching the gauge seal 62' to the panel. Lobe 96' defines a recessed area 102' which is generally similar to recessed area 102.

Figure 6:
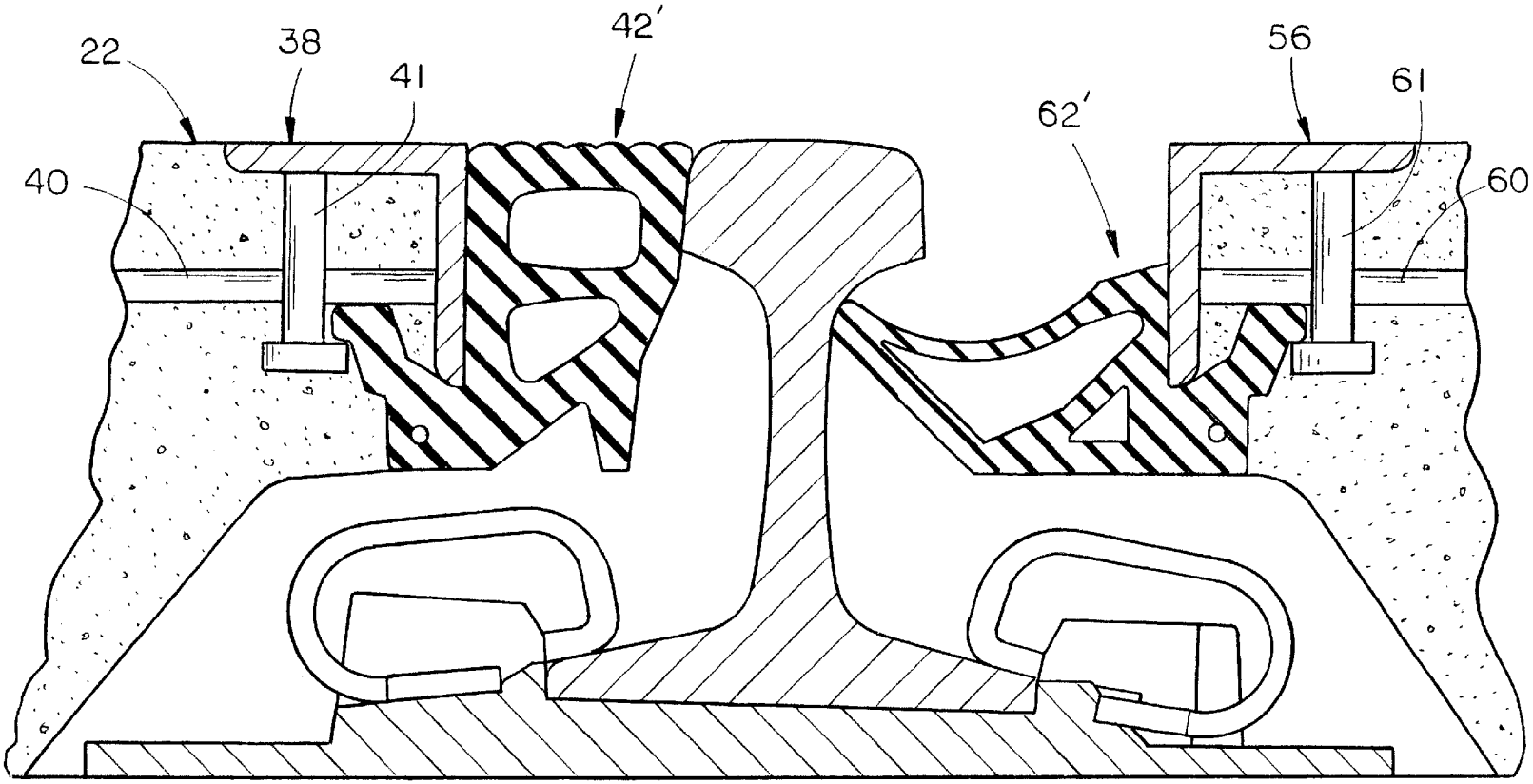
FIG. 6 is a partial vertical sectional view of a third embodiment of the concrete railroad grade crossing of this invention.

FIG. 6 illustrates a third embodiment of the invention. The only difference between the embodiment of FIG. 5 and the embodiment of FIG. 6 is that the upper end of the approach seal 42' is substantially co-planar with the upper end of the edge protector 38 and the approach panel 26.

Thus it can be seen that the invention accomplishes at least all of its stated objectives.

We claim:

1. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals generally having upper and lower ends and inner and outer ends;

each of said inner ends of said gauge seals having a lobe which protrudes outwardly from said inner ends of said gauge seals and is embedded in said gauge panel at the sides thereof;

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof which are positioned adjacent the associated rail;

each of said approach seals generally having an inner end, an outer end, an upper end, and a lower end;

each of said inner ends of said approach seals having a lobe which protrudes outwardly from said inner ends of said approach seals and is embedded in said inner ends of said approach panels.

2. The railroad crossing of claim 1 wherein each of said gauge and approach seals have elongated voids formed therein.

3. The railroad crossing of claim 1 wherein metal angle members are cast in said upper inner ends of said approach panels.

4. The railroad crossing of claim 3 wherein metal angle members are cast in said upper opposite sides of said gauge panel.

5. The railroad crossing of claim 4 wherein said seals have recessed areas; said angle members having portions thereof which extend downwardly into said recessed areas of said seals and wherein concrete is positioned between the associated lobe and the angle member portion received in the recessed area.

6. The railroad crossing of claim 1 wherein metal angle members are cast in said upper opposite sides of said gauge panel.

7. The railroad crossing of claim 1 wherein said top surfaces of said approach seals have ribbed surfaces formed therein.

8. The railroad crossing of claim 1 wherein each of said lobes includes an enlarged head portion and a neck portion.

9. The railroad crossing of claim 8 wherein each of said lobes has at least one downwardly presented shoulder.

10. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having an elastomeric gauge seal on each side thereof which is positioned adjacent an associated rail;

each of said gauge seals having upper and lower ends and inner and outer ends;

each of said gauge seals having a lobe formed in its inner end, said lobe protruding outwardly from said inner end of said gauge seal;

said lobes on said gauge seals being embedded in said gauge panel at the sides thereof.

11. The railroad crossing of claim 10 wherein said gauge seals have elongated voids formed therein.

12. The railroad crossing of claim 10 wherein each of said lobes has an enlarged head portion and a neck portion formed thereon.

13. The railroad crossing of claim 12 wherein each of said lobes has at least one downwardly presented shoulder.

14. An approach panel for a railroad grade crossing for extending a roadway across a pair of parallel, spaced-apart rails which are supported upon spaced-apart ties, comprising:

a pair of concrete approach panels, one of which extends between each rail and the roadway;

each of said concrete approach panels generally having an inner end, an outer end, a top surface which is substantially coplanar with the roadway, and a bottom surface which is supported upon the ties;

said approach panels having elastomeric approach seals at their inner ends thereof;

each of said approach seals having an inner end, an outer end, an upper end, and a lower end;

each of said inner ends of said approach seals having a lobe which protrudes outwardly from said inner ends of said approach seals and is embedded in said inner ends of said approach panels.

15. The approach panel of claim 14 wherein said lobes define recessed areas which partially receive a portion of metal angle members which are embedded in said inner ends of said approach panels.

16. The railroad crossing of claim 14 wherein each of said lobes has an enlarged head portion and a neck portion formed thereon.

17. The railroad crossing of claim 16 wherein each of said lobes has at least one downwardly presented shoulder.

18. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals generally having upper and lower ends and inner and outer ends;

each of said inner ends of said gauge seals having a lobe which is embedded in said gauge panel at the sides thereof;

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof which are positioned adjacent the associated rail;

each of said approach seals generally having an inner end, an outer end, an upper end, and a lower end;

each of said inner ends of said approach seals having a lobe which is embedded in said inner ends of said approach panels;

each of said lobes including an enlarged head portion;

each of said lobes having at least one downwardly presented shoulder;

and angle members being cast in said panels and which have retainers extending downwardly therefrom which have enlarged head portions thereon; and wherein each of said lobes has an enlarged head portion formed thereon which is in engagement with said enlarged head portions of said retainers.

19. The railroad crossing of claim 18 wherein said lobes define recessed areas in said gauge seals and wherein metal angle members are cast in said opposite sides of said gauge panel with portions thereof being positioned in said recessed areas of said gauge seals.

20. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals generally having upper and lower ends and inner and outer ends;

each of said inner ends of said gauge seals having a lobe which is embedded in said gauge panel at the sides thereof;

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof which are positioned adjacent the associated rail;

each of said approach seals generally having an inner end, an outer end, an upper end, and a lower end;

said upper ends of said approach seals being substantially co-planar with said top surface of the associated approach panel;

each of said inner ends of said approach seals having a lobe which is embedded in said inner ends of said approach panels;

each of said seals having an upwardly presented, generally V-shaped recessed area found thereon;

said inner ends of said approach panels and said opposite sides of said gauge panel having mutual angle members cast therein and wherein said angle members have portions thereof which extend downwardly into said recessed areas.

21. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having elastomeric gauge seals on each side thereof which are positioned adjacent the rails;

each of said gauge seals generally having upper and lower ends and inner and outer ends;

each of said inner ends of said gauge seals having a lobe which is embedded in said gauge panel at the sides thereof;

a pair of concrete approach panels, one of which extends between each rail and the roadway;

each of said concrete approach panels having an inner end, an outer end, a top surface which is substantially coplanar with the roadway, and a bottom surface which is supported upon the ties;

said approach panels having elastomeric approach seals at their inner ends thereof which are positioned adjacent the associated rail;

each of said approach seals generally having an inner end, an outer end, an upper end, and a lower end;

each of said inner ends of said approach seals having a lobe which is embedded in said inner ends of said approach panels;

each of said lobes of said seals defining an upwardly presented recessed area in the respective seal which receives concrete therein to aid in securing the seal to the respective panel.

22. A railroad grade crossing for extending a roadway across a pair of parallel, spaced-apart rails which are supported upon spaced-apart ties, comprising:

a concrete gauge panel extending substantially between the rails;

said gauge panel having a top surface which is substantially coplanar with the roadway;

said gauge panel having a bottom surface which is supported upon the ties;

said gauge panel having opposite sides;

said gauge panel having an elastomeric gauge seal on each side thereof which is positioned adjacent a respective rail;

each of said gauge seals having upper and lower ends and inner and outer ends;

each of said gauge seals having a lobe formed in its inner end;

said lobes on said gauge seals being embedded in said gauge panel at the sides thereof;

each of said lobes having an enlarged head portion formed therein;

each of said lobes having at least one downwardly presented shoulder;

and angle members being cast in said panels which have retainers extending downwardly therefrom which have enlarged head portions thereon; and wherein each of said lobes has an enlarged head portion formed thereon which is in engagement with said enlarged head portions of said retainers.

23. An approach panel for a railroad grade crossing for extending a roadway across a pair of parallel, spaced-apart rails which are supported upon spaced-apart ties, comprising:

a pair of concrete approach panels, one of which extends between each rail and the roadway;

each of said concrete approach panels generally having an inner end, an outer end, a top surface which is substantially coplanar with the roadway, and a bottom surface which is supported upon the ties;

said approach panels having elastomeric approach seals at their inner ends thereof;

each of said approach seals having an inner end, an outer end, an upper end, and a lower end;

each of said inner ends of said approach seals having a lobe which is embedded in said inner ends of said approach panels;

each of said lobes having an enlarged head portion formed thereon;

and angle members being cast in said panels which have retainers extending downwardly therefrom and which have enlarged head portions thereon; and wherein each of said lobes has an enlarged head portion formed thereon which is in engagement with said enlarged head portions of said retainers.

* * * * *